US005219420A

United States Patent [19]

Kiiski et al.

[11] Patent Number: 5,219,420

[45] Date of Patent: Jun. 15, 1993

[54] PROCEDURE FOR THE CONTROL OF A CRANE

[75] Inventors: Tapani Kiiski; Juha Mailisto, both of Hyvinkaa, Finland

[73] Assignee: Kone Oy, Helsinki, Finland

[21] Appl. No.: 853,541

[22] Filed: Mar. 18, 1992

[30] Foreign Application Priority Data

Mar. 18, 1991 [FI] Finland ..... FI911320
Feb. 21, 1992 [FI] Finland ..... FI920751

[51] Int. Cl.[5] ..... B66C 19/00
[52] U.S. Cl. ..... 212/147
[58] Field of Search ..... 212/147, 148, 132, 161, 212/146, 159, 205, 270

[56] References Cited

U.S. PATENT DOCUMENTS

| | | | |
|---|---|---|---|
| 3,517,830 | 6/1970 | Virkkala . | |
| 4,512,711 | 4/1985 | Ling et al. | 212/147 |
| 4,603,783 | 8/1986 | Tax et al. | 212/147 |
| 4,717,029 | 1/1988 | Yasunobu et al. | 212/147 |
| 4,756,432 | 7/1988 | Kawashima et al. | 212/147 |

OTHER PUBLICATIONS

New Feedback Control System for Overhead Cranes, A. J. Ridout, Post Graduate Student, NSW Institute of Technology, pp. 136–140.

*Primary Examiner*—Jesus D. Sotelo
*Assistant Examiner*—Stephen P. Avila

[57] ABSTRACT

Procedure for damping the swing of the load of a crane during the traversing motion of the trolley and/or bridge when the trolley bridge is controlled by a signal which controls the traversing motor. The length of the hoisting rope is determined and used for the calculation of the time of oscillation of the load swing, and when a new speed setting is given, a control signal compensating the swing prevailing at the moment and another control signal changing the speed are generated. From an equation for load swing, the momentary total oscillation generated by previous control actions is determined. The compensating control signal includes a first acceleration reference and a second acceleration reference, or alternatively, suitable unrealized parts of acceleration sequences. The speed change is achieved by giving new acceleration sequences which change the speed to a value corresponding to the new setting without generating oscillation.

19 Claims, 6 Drawing Sheets

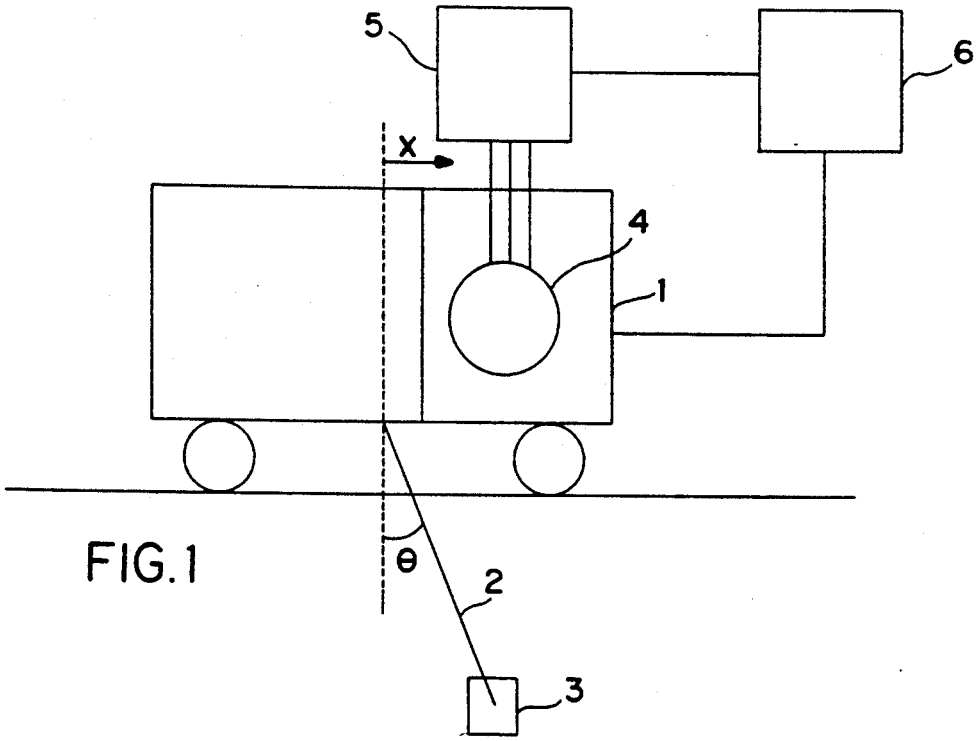
FIG.1
FIG.3(a)
FIG.3(b)
FIG.3(c)
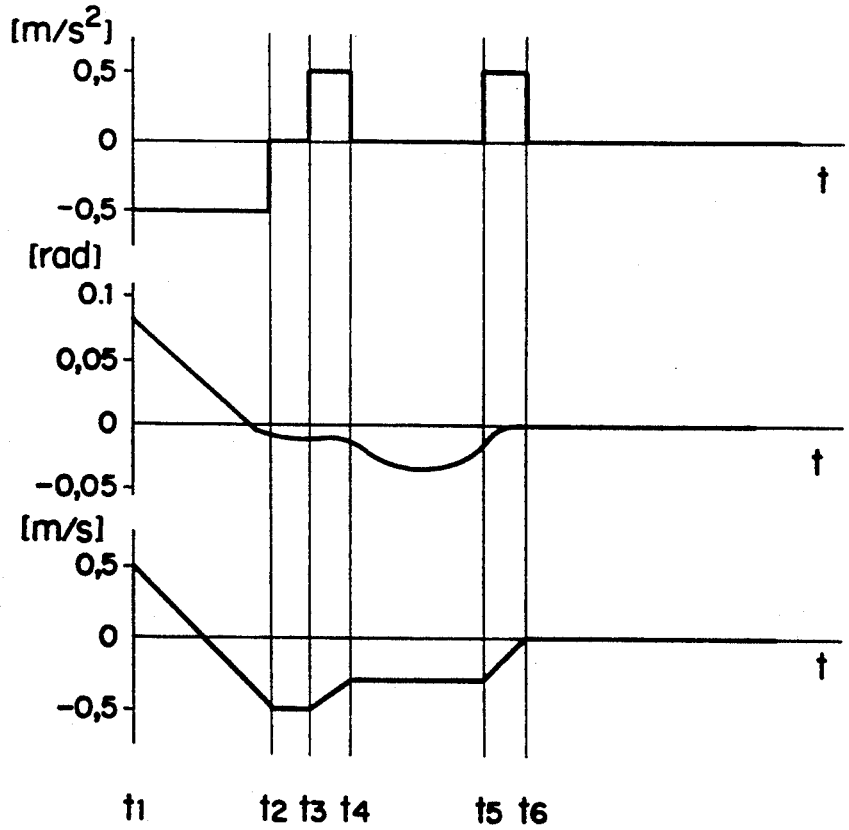

[rad]
0.1
0
-0,1
t

[m/s2]
1
0
U1
t

[rad]
0
-0,1
-0,2
t

[m/s2]
0
-0,5
-1
U2
t

[rad]
0.1
0,05
0
t

[m/s2]
0
-0,5
U3
t

[rad]
0.1
0
-0,1
t
t1
t2
t3
t4
t5
t6 a1
a2
t a11
a22
t t
a3
a4 t
V
V1 t
Vmax
to t1
t3
T/2
t1+T/2
t3+T/2

PROCEDURE FOR THE CONTROL OF A CRANE

FIELD OF THE INVENTION

The present invention relates to a procedure for controlling the traversing motor of a crane so as to eliminate load swing, as defined in the introductory part of claim 1.

BACKGROUND OF THE INVENTION

The swing of the load suspended on a hoisting rope is a notable problem when a crane is used to handle materials. During the traversing motion, changes in the traversing speed always generate load swing of an amplitude depending on the length of the hoisting rope and the rate of speed change, i.e. acceleration. The elimination of load swing has been the subject of a great deal of investigation, and automatic systems to solve the problem have been developed. Examples of these can be found in FI patent 44036 (B66c 13/06) and conference publication Electric Energy Conference 1987, Adelaide, pp. 135–140. A feature common to these systems is that the goal of the traversing movement is already known at the moment of starting. An optimal speed profile is computed for the movement, and if this speed profile is observed, no swing occurs at the end of the movement and the time consumed to perform it is minimized.

In crane drives in which the traversing movement is controlled by the operator, damping load swing by the methods presented in the above-mentioned references is only possible if the operator works in accordance with certain conditions:

- the operator changes the traversing speed setting in a stepwise manner to the desired speed at the start of the motion,
- the operator maintains the same speed setting for at least a minimum time depending on the height of the load,
- the operator changes the speed setting in a stepwise manner when changing the target speed, and
- the operator performs no new control actions before the system has reached a condition with no load swing.

Previously known is a technique whereby the traversing movement of a crane is so controlled that the load is in a no-swing condition when a new speed setting is given. The traversing speed is changed by using two acceleration sequences of equal length and separated from each other by half an oscillation cycle.

The principle described above can also be improved in a way that enables it to work under an arbitrary speed setting. If the operator's control actions permit, i.e. if the conditions presented above are fulfilled, a "natural motion curve" minimizing load swing, defined in a manner described in the publications referred to above, is observed. However, if the operator performs arbitrary control actions, the crane has to obey them because the operator must have the best possible control over the machine. As a consequence of arbitrary control actions and in operational situations where the above conditions are not fulfilled, the "natural motion curve" cannot be observed. Therefore, the swing generated by the control of the traversing movement cannot be compensated.

When the crane is controlled by giving the trolley a speed setting, the quickest way of reaching the desired speed is to control the motor at maximal acceleration until the target speed is reached. However, according to the references, to achieve swing-free traversal, an acceleration sequence must be followed by a corresponding acceleration sequence half an oscillation cycle later, increasing the stopping time and distance. The acceleration of the trolley is proportional to the torque of its motor and further to the current. Because of the motor current limitations, a given acceleration limit cannot be exceeded. In addition, the control system and the operating environment often impose other limitations, such as a maximum speed limit.

When a load is being moved by a crane, the crane operator should always have a good feel for the system. Speed changes and swing damping have to take place quickly. The velocity of the load should not exceed the speed setting by a large margin, and the load and the parts of the crane, such as the bridge or the trolley, should not move in a direction opposite to the control. When the speed reference changes, the load speed has to change immediately in the direction required by the change in the reference, especially when the speed reference is diminished.

The distance required to stop the load should only be dependent on the speed of the load and it should not vary according to the situation which prevailed at the moment when the stopping request was given. The distance through which the load travels after the speed reference has been set to zero should be minimized.

SUMMARY OF THE INVENTION

In a general, arbitrary case, load swing cannot be regarded as compensated at a random instant during traversal. Therefore, the invention aims at achieving a procedure for controlling the traversing movement of a crane in which the swing is damped in a controlled manner. features According to the invention, the instantaneous kinetic condition of the load is determined and, on the basis of the condition, the traversing movement of the crane is controlled so as to bring the load to a swing-free kinetic condition corresponding to a new reference, e.g. a new speed. In a general case, to enable the swing prevailing at the moment of change of the speed setting to be compensated, it is necessary to give a control signal proportional to the amplitude of the swing. At the same time, the traversing speed of the trolley must be changed to match the speed setting, proceeding along a course that does not generate load swing.

The kinetic condition is determined either by measuring the angle of deflection of the load and the angular velocity of the swing or on the basis of previous trolley control actions by means of the acceleration sequences and the length of the hoisting rope as explained in greater detail in a subsequent detailed description. In the former case, the load swing is described by an equation from which the instantaneous kinetic condition and the control actions required to compensate the swing are determined. In certain cases it is possible to make simplifying assumptions, allowing the angle of deflection and the angular speed of the swing to be calculated directly from the equation. If such assumptions are not possible, the quantities in question are calculated numerically. In the latter case, the control actions compensating the swing are determined directly on the basis of control actions performed before and the required control signal is produced.

Other embodiments of the invention are presented in the subclaims.

BRIEF DESCRIPTION OF THE DRAWINGS

In the following, the invention is described in detail by referring to the drawings, in which FIG. 1 presents the structural principle of a crane, FIGS. 2(*a*)–(*g*) present the angle of deflection of the load, acceleration reference signals according to the invention, and the swing generated by them, all as functions of time, FIGS. 3(*a*)–(*c*) present the whole trolley control, the load swing and the trolley speed as functions of time, FIGS. 4(*a*)–(*e*) present acceleration reference sequences in a procedure according to another embodiment of the invention.

DETAILED DESCRIPTION OF PREFERRED EMBODIMENTS

Figures 2A, 2B, 2C, 2D, 2E, 2F, 2G:
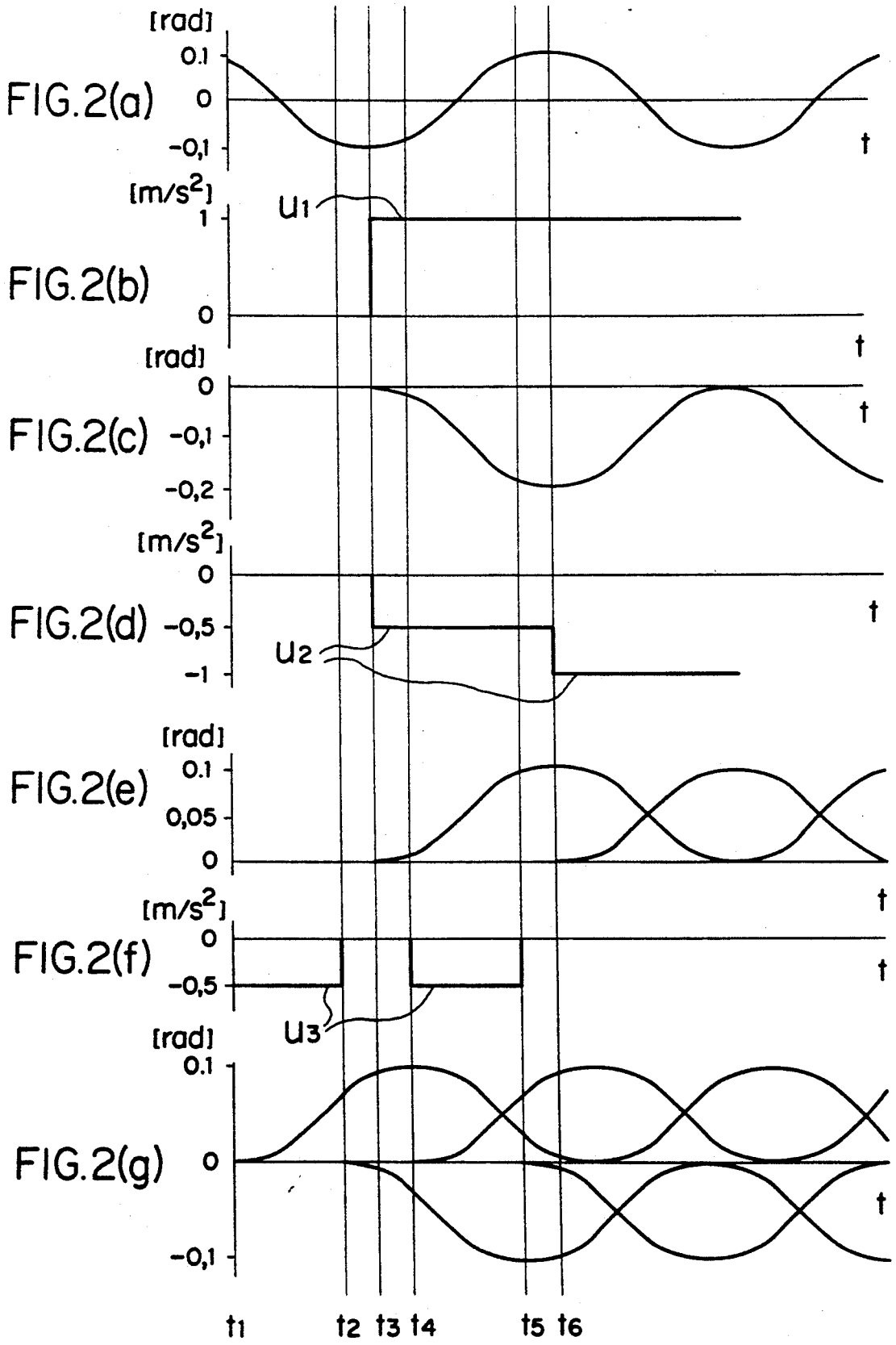

FIG. 1 is a diagram representing the structure of a crane, in which the trolley 1 supports a load 3 suspended on a rope 2. The trolley is moved by a traversing motor 4, whose speed is controlled by a regulating unit 5, which can be e.g. a converter. The crane operator gives a speed setting to the control unit 6 by means of a controller. The control unit produces the control signal required by the speed setting by determining acceleration sequences that the regulating unit 5 has to observe. The length of the rope 2 is determined e.g. in the manner described in publication FI 44036 or by measuring it by means of a suitable measuring instrument in an manner known in itself. The rope length data is supplied to the control unit 6. Although only the trolley traversing movements are described here, the presentation also applies to the movements of the crane bridge and to the load swing and compensation caused by them.

Below is a description of the way in which the kinetic condition of the load is determined in a system like that in FIG. 1. Due to a change in the speed of the traversing movement of the trolley 1, the load 3 sways through an angle Θ from the vertical plane. The oscillation is determined by the length l of the hoisting rope 2 and its change l', and by the acceleration of the trolley, i.e. of the point of suspension of the rope. Assuming that the angles of deflection are small and that the deadening of the swing can be ignored, the swing can be described mathematically with sufficient accuracy by means of the following equation:

$$l\cdot\Theta'' = -u - 2\cdot\Theta'\cdot l' - g\cdot\Theta \qquad (1)$$

where l is the length of the hoisting rope, l' is the 1st derivative of the hoisting rope, i.e. the hoisting or lowering speed of the load, Θ is the angle of deflection of the load, i.e. the deviation of the rope from the vertical plane, Θ' is the 1st derivative of the angle of deflection, i.e. the angular speed, Θ'' is the 2nd derivative of the angle of deflection, i.e. the angular acceleration, u is the acceleration of the point of suspension in the horizontal direction and g is the acceleration of free fall.

From equation (1) it is possible to determine the instantaneous angle of deflection and velocity of oscillation for different ways of crane operation, the trolley acceleration u and hoisting rope length l being arbitrary and continuously derived functions of time. If during the traversal, the load is simultaneously raised or lowered, equation (1) cannot always be solved in the closed form, but it can be solved by numeric methods.

If the hoisting velocity l' is low, the oscillation equation (1) can be reduced to the form $$l\cdot\Theta'' = -u - g\cdot\Theta \qquad (2).$$

On the basis of the hoisting rope length and trolley acceleration, the period of oscillation T, the angle of deflection Θ and the oscillation velocity Θ' can be determined as functions of time. When the hoisting rope length l is constant, these quantities have the following values:

$$T = 2\cdot\pi\cdot\sqrt{l/g} \qquad (3)$$

$$\Theta = \Theta(t) = u/g\cdot\cos(\sqrt{l/g}\cdot t) - u/g \qquad (4)$$

$$\Theta' = \Theta'(t) = -u/g\cdot\sqrt{l/g}\cdot\sin(\sqrt{l/g}\cdot t) \qquad (5)$$

When the angle of deflection Θ(t) is determined for different operating situations, i.e. for different trolley accelerations u and hoisting rope lengths l, it will be seen that the angle of deflection is determined by the cumulative effect of the changes of acceleration. This is because Θ and Θ' are not dependent on an initial value (Θo), Θ-values resulting from different changes of u are independent of each other. The length of the hoisting rope can be measured by various methods known in themselves.

When the angle of deflection, oscillation velocity and trolley acceleration are known, the momentary state of the oscillation at any instant t can be represented in the form $$\Theta = A\cdot\cos(\sigma + 2\cdot\pi\cdot t/T) + B \qquad (6)$$

where σ is the cumulated phase difference resulting from the trolley acceleration control actions and B is a constant proportional to the acceleration of the trolley.

In the procedure of the invention, the swing according to equation (6) is limited to zero as soon as possible after the speed setting has been changed or when the swing or some other preselected quantity exceeds the allowed value. When the operator changes the setting, the traversing motor of the trolley is so controlled that the prevailing swing is eliminated and the set speed is reached. The new speed setting is fed into the control unit, which, based on previous control signals, generates the acceleration references for the regulating unit, which, in the manner thus determined, brings the motor speed to a value equal to the set value. The control signal determining the acceleration of the traversing motor is generated in the manner described below.

To compensate the swing prevailing at the moment of change of the speed setting, it is necessary to give a control signal which is proportional to the amplitude A of the oscillation. The trolley traversing speed must also be brought to the level of the speed setting in a manner that generates no swing. This can be implemented as follows:

The zero point of time is defined as the instant when the movement was first started during the traversal in question. In this case, the phase of the oscillation can be calculated from equation (6).

After a new speed setting has been given, the apparatus selects within the framework of the prevailing limitations, i.e. within the allowed limits for acceleration, torque and speed, of two control alternatives both of which will eliminate load swing, the one that leads to the shorter time of velocity change:

the acceleration of the speed of the crane trolley is corrected by $A \cdot g$ at instant $t' = (2n+1) \cdot T/2 - \sigma \cdot T/(2 \cdot \pi)$, or the acceleration of the speed of the crane trolley is corrected by $-A \cdot g$ at instant $t'' = n \cdot T/(2 \cdot \pi)$, where $n = 0,1,2,3, \ldots$, $t'$ and $t''$ having values larger than the current instant.

To cancel the acceleration change performed to eliminate load swing, acceleration changes equal to $-A \cdot g/2$ (or $A \cdot g/2$) are performed at instants $t'$ (or $t''$) and $t' + T/2$ (or $t'' + T/2$).

Moreover, simultaneously with the application of swing compensating control signals, acceleration changes are performed which generate no swing and which result in the traversing speed changing to a level corresponding to the new reference.

The acceleration profile for the deceleration sequence is obtained as the sum of the above-mentioned acceleration control signals, from which also the speed profile is obtained as a function of time $v = v(t)$.

FIGS. 2 and 3 illustrate the damping of load swing by the control procedure of the invention when a speed setting of $v = 0$, i.e. a stopping command, is given. The trolley speed at the instant t1 when the stopping command is given is v1 and the load is swinging because of the control actions performed. FIG. 2*a* represents the total swing generated during the traversing movement as a function of time as it would occur if no control actions were performed after the instant t1 when the stopping command was given. In the case represented by FIG. 2, there are no new changes in acceleration after instant t1.

The acceleration control signals compensating the swing and stopping the motion are presented in FIGS. 2*b*, 2*d* and 2*f* in accordance with the above example. Correspondingly, the load oscillations caused by the acceleration control signals are presented in FIGS. 2*c*, 2*e* and 2*g*. According to the invention, an acceleration reference signal u1 compensating the load oscillation is issued at instant t3. The signal is of a magnitude that compensates the oscillation prevailing at the moment when the stopping command is given. This causes load oscillation as illustrated by FIG. 2*c* as a function of time. At instants t3 and $t6 = t3 + T/2$, in order to cancel the oscillation caused by acceleration reference u1, the acceleration reference is changed by means of an acceleration reference signal whose changes are of a magnitude equal to half the magnitude of u1 and opposite in sign relative to it. FIG. 2*e* represents the corresponding oscillations.

To stop the trolley from the speed prevailing at the moment when the stopping command is given, an acceleration reference signal lasting from instant t1 to instant t2 and another acceleration reference signal lasting from instant t4 to instant t5 are issued, as shown in FIG. 2*f*. The oscillation components corresponding to the changes in acceleration are presented in FIG. 2*g*.

The combined total effect of the control signals described above is presented in FIG. 3. The trolley is controlled by an acceleration sequence as represented by FIG. 3*a*. The oscillation shown in FIG. 2*a* is now damped according to FIG. 3*b* between the stopping command t1 and the instant t6 of stopping. FIG. 3*c* shows the variation of the trolley speed during the stopping operation. Thus, the locations of the trolley and the load at different instants of time can be easily determined.

Swing compensation is performed in a corresponding manner in connection with other changes of the speed setting as well. Swing compensation can also be performed at other times except the moment when the speed setting is changed, e.g. if the angle of deflection or the oscillation velocity exceeds a preset limit. In this case, the motor is given acceleration reference signals that eliminate the prevailing oscillation but do not change the speed of the traversing movement.

Figure 4:
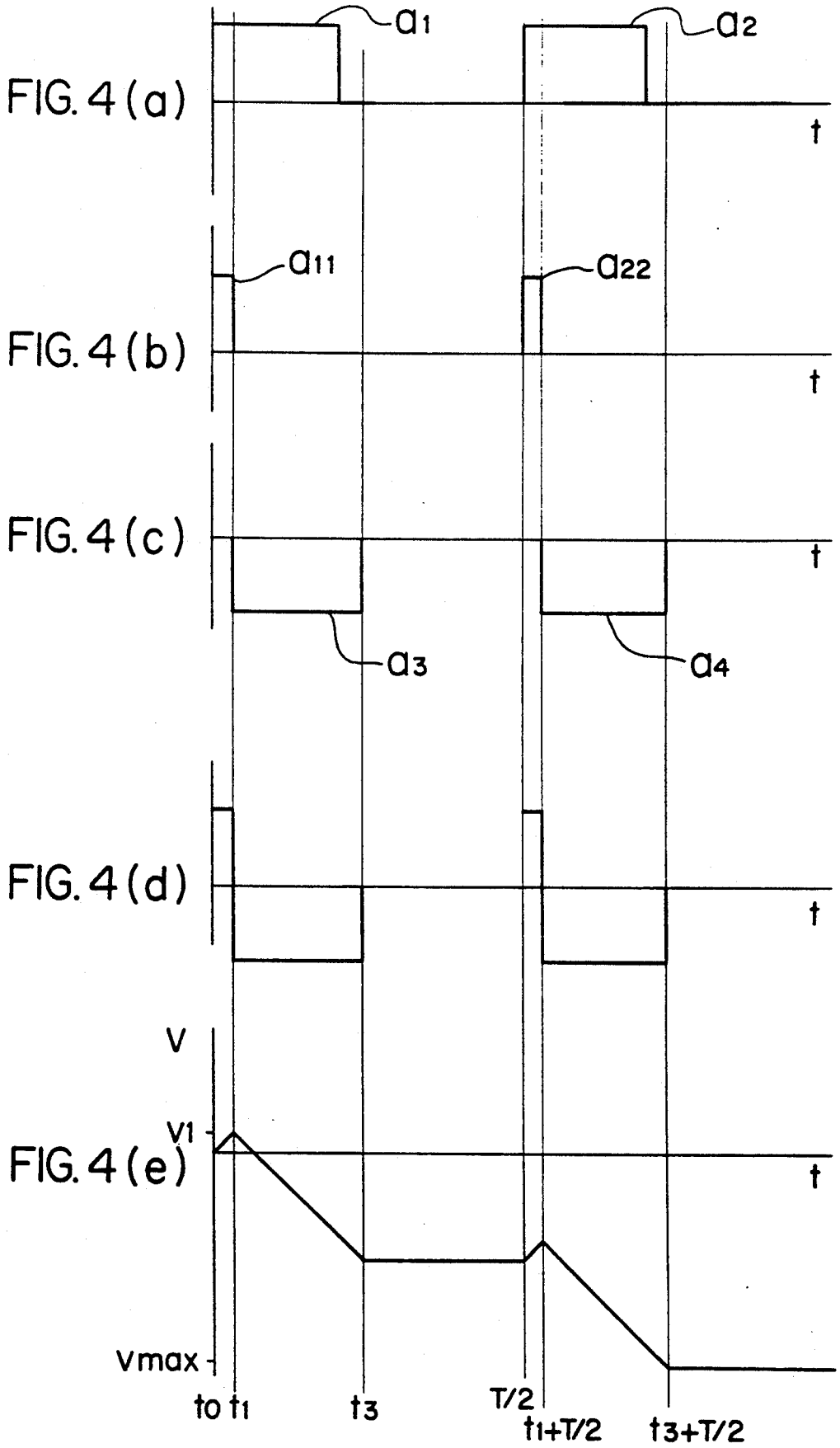

FIG. 4 presents the acceleration reference sequences for the traversing motor of a crane in another embodiment of the invention, in which the acceleration sequences determined by previous control actions are stored in a memory provided in the control system. The acceleration sequences compensating the oscillation are defined directly by means of previous control actions without evaluating the oscillation equation.

Let us consider a situation in which a speed setting $v_{ref} = v_{max}$ has been issued at instant $t_o$ when the trolley was standing still. Consequently, motor acceleration sequences $a_1$ and $a_2$ are generated, resulting in the highest acceleration possible, $ACC_{max}$ (FIG. 4*a*).

At instant $t_1$, the speed setting is changed $v_{ref} = -v_{max}$. Due to the acceleration sequence $a_{11}$ between instants $(t_o, t_1)$ the speed has been changed to $v = v_1$ and the angle of deflection of the load is $\Theta_1$. To compensate the oscillation, the motor must be accelerated by giving a corresponding acceleration sequence $a_{22}$ half a cycle after the start of the control operation, as illustrated by FIG. 4*b*. To realize the speed setting, the motor is accelerated in the opposite direction during sequences $a_3$ and $a_4$, which are separated from each other by half a cycle (FIG. 4*c*). The total control thus consists of the sequences presented in FIG. 4*d*. The speed is changed correspondingly to the set value $v = -v_{max}$ in the manner shown in FIG. 4*e*.

In general, the aim is to reach the set value of the speed as soon as possible after the control action, and this requires the use of the highest possible acceleration. In practice, however, situations may occur in which it is not possible to immediately realize the acceleration required by a new speed setting given by the operator, e.g. because of a current limitation. In this case, the realization of the new setting must be delayed.

Figure 5:
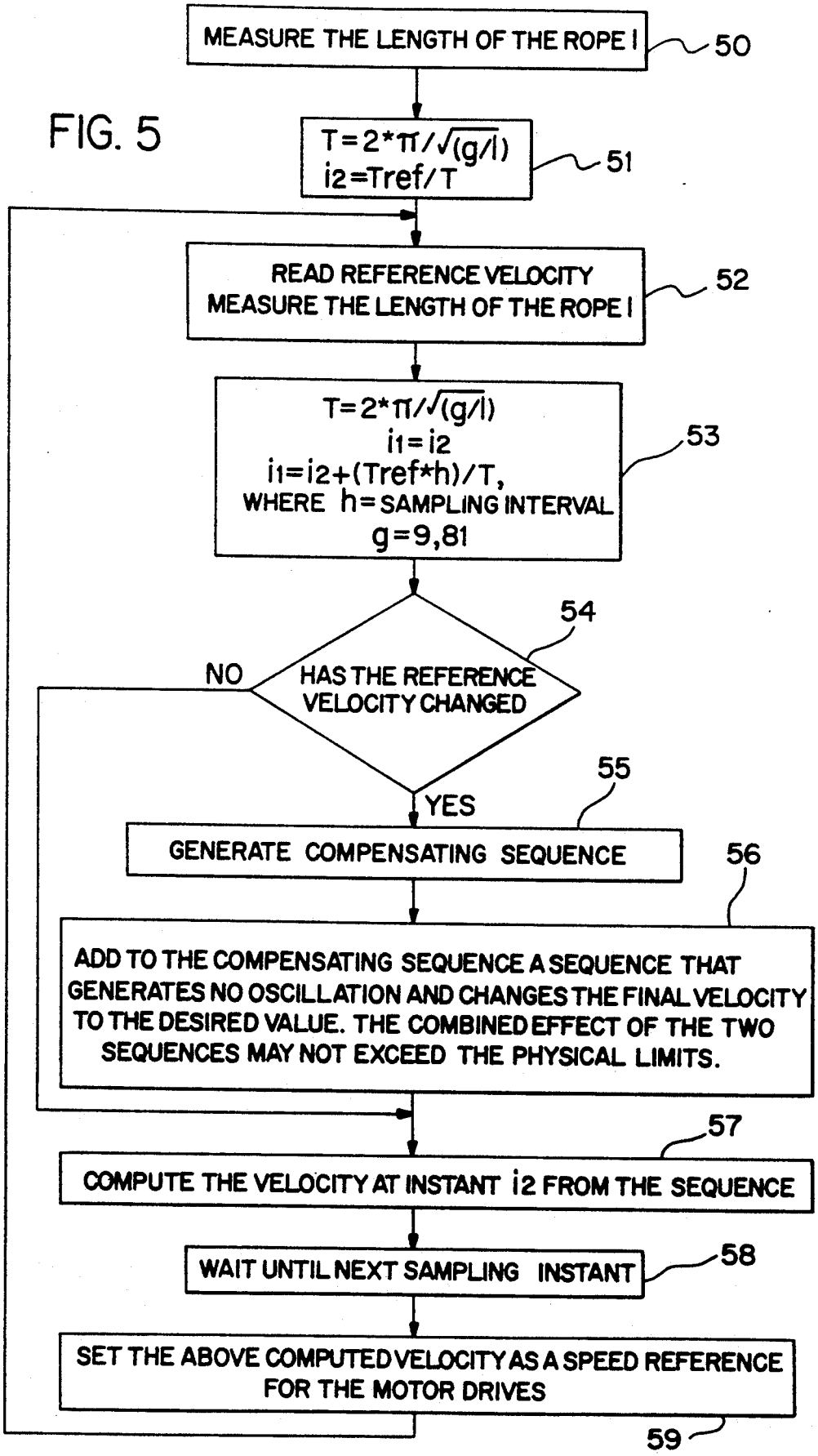
FIG. 5 is a flow diagram representing the implementation of another embodiment.

In this embodiment of the invention, the control of the crane trolley is implemented by means of a microprocessor in such manner that the acceleration sequences resulting from a control action are stored in a memory in the control unit after a speed setting has been given. The control unit gives the motor regulating unit a reference signal according to which the regulating unit adjusts the motor speed to a value corresponding to the setting. When a new reference is issued, the acceleration sequences generated by the old references are removed and the required new sequences are added in the manner described in the accompanying flowcharts, as follows:

According to the invention, the control is implemented so that the speed settings and acceleration sequences are updated in the control system at certain sampling intervals. The control is effected in accordance with the flowchart in FIG. 5. In blocks 50 and 51, the rope length l is measured and the oscillation cycle duration T corresponding to the rope length l is calculated from equation (3). The sampling instant $i_2$, scaled to the rope length in question by using the formula $i_2=T_{ref}/T$, where $T_{ref}$ is the time of oscillation corresponding to a reference rope length, is determined. In blocks 52 and 53, the speed setting is read from memory and the instantaneous rope length value is measured. The time of oscillation T is calculated from equation (*3*), and the starting instant $i_1$ selected for the consideration is the previous sampling instant $i_2$. The new sampling instant $i_2$ is calculated by adding to the previous value the sampling interval h multiplied by the factor $T_{ref}/T$.

In selection block 54 a check is performed to establish whether the speed setting has changed since the previous sampling instant. If the setting has changed, then the system will generate swing-compensating acceleration sequences (block 55), to which it adds (in block 56) acceleration reference sequences which will not generate oscillation and which will change the speed to a level corresponding to the setting, as illustrated by the flow diagrams in FIG. 6 and 7. After this, and also when the speed setting has not changed, the speed at instant $i_2$ is calculated in blocks 57 -59 and this calculated speed is set as the speed reference for the motor drive.

Figure 6:
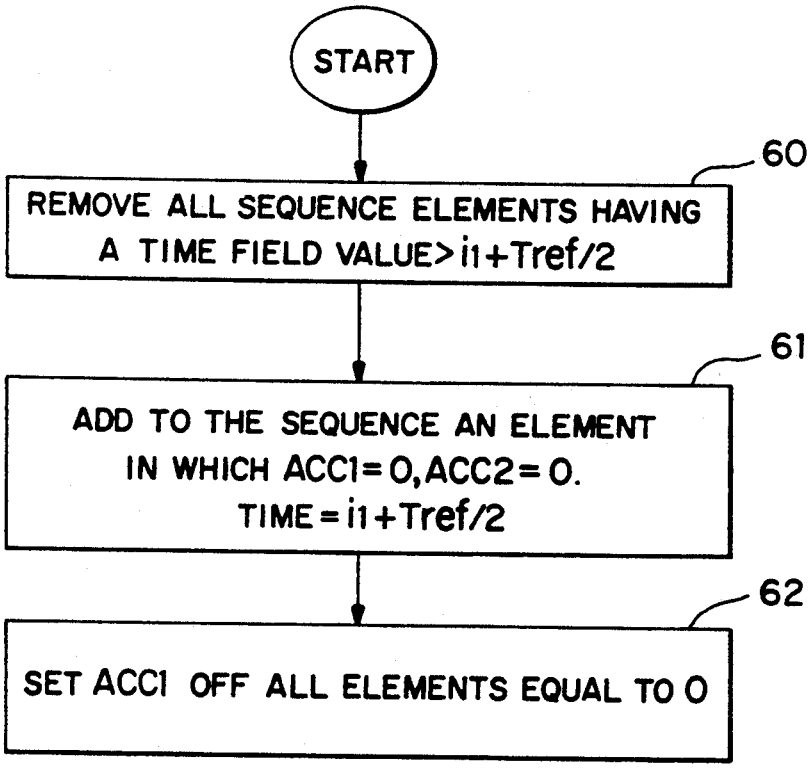
FIG. 6 is a flow diagram representing the compensation of swing.

The acceleration sequence compensating the oscillation is generated in the manner presented in the flowchart in FIG. 6. According to the control action in question, the acceleration reference sequences consist of a sequence consisting of two acceleration sequences ACC1 and ACC2, which are equal in duration and magnitude and placed at a distance of half an oscillation cycle from each other as shown in FIG. 4. The sequences are stored in memory in the form of elements which contain data representing the starting instant, category (ACC1/ACC2) and value of the acceleration sequences comprised in them, as well as the address of the next element of the sequence. When oscillation is to be compensated, all sequence elements with a time field having a value exceeding $i_1+T_{ref}/2$ (block 60) are removed. An element having ACC1=0 and ACC2=0 and a time field value $=i_1+T_{ref}/2$ is added to the sequence, and the second acceleration sequences (block 61) corresponding to unrealized first acceleration sequences are removed. Finally, ACC1 of all elements of the sequence is set =0, whereby all existing unrealized first acceleration sequences (block 62) are removed. According to the invention, the oscillation generated by this manner of control is compensated because an acceleration sequence is always followed by a corresponding second acceleration sequence of equal magnitude, placed at a distance of half an oscillation cycle from the one already realized.

Figure 7:
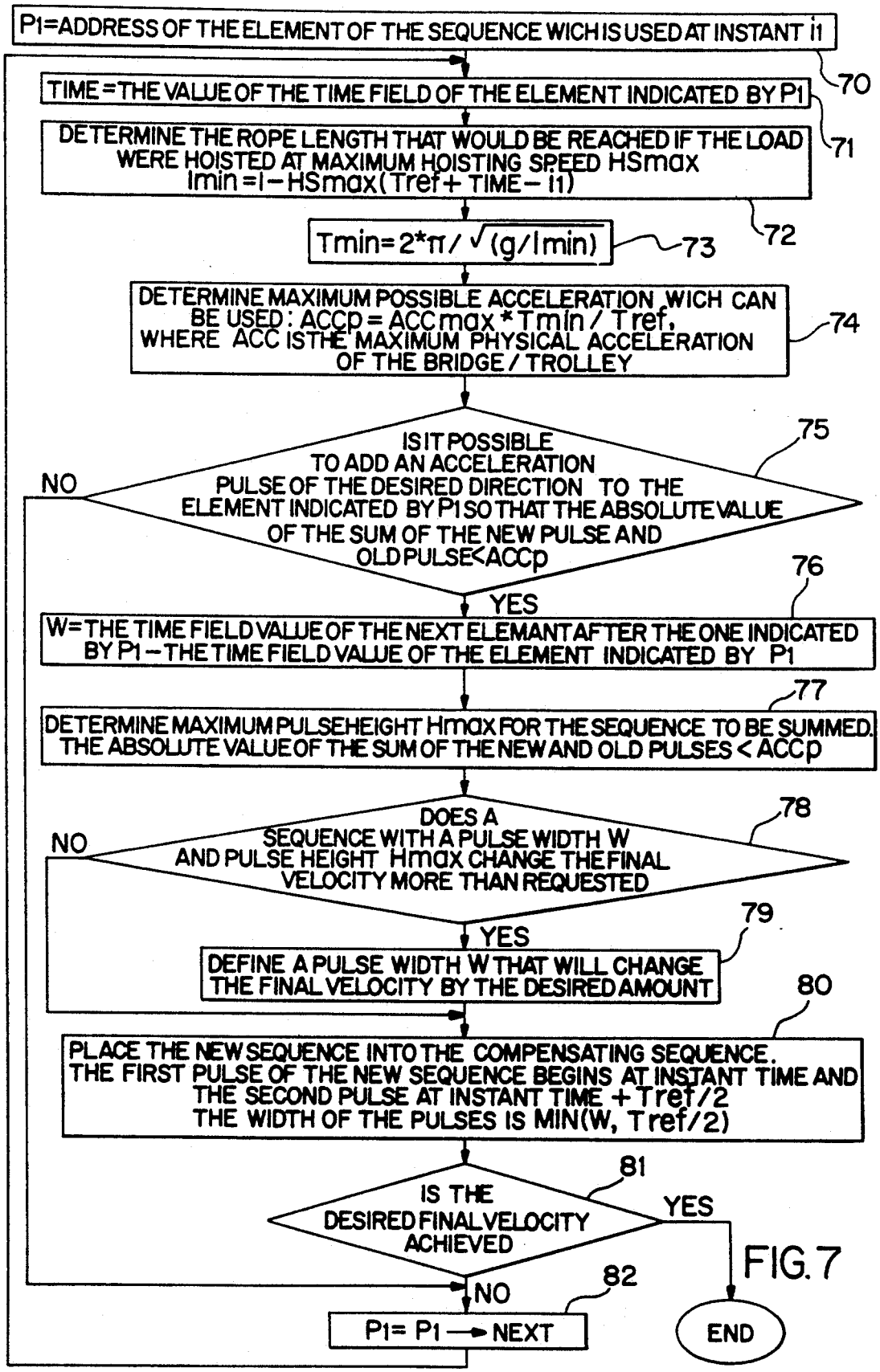
FIG. 7 is a flow diagram representing the changing of the final speed.

The acceleration sequences that change the final speed are generated in accordance with the flowchart in FIG. 7. In blocks 70–74, the address of the element which is valid at instant $i_1$ is assigned to P1 and the value (=TIME) of the time field of the element indicated by P1 is determined. Next, the highest possible acceleration $ACC_p$ that can be used is calculated. For this purpose, the rope length $l_{min}$ which would be achieved if the load were hoisted at the maximum hoisting speed $HS_{max}$ is determined from an approximate formula and the corresponding minimum oscillation time $T_{min}$ from equation (3). $ACC_p$ is determined as the ratio of the minimum and reference oscillation times from the physical maximum acceleration $ACC_{max}$ of the trolley/-bridge.

In selection block 75 a check is performed to see if it is possible to add a new acceleration pulse of the desired magnitude to the element indicated by P1 without exceeding the highest possible acceleration $ACC_p$. If this is not possible, execution proceeds to the next element after P1. If the the highest possible acceleration can be observed, the largest possible width W of the new acceleration reference pulse is determined in block 76 as the difference beween the time fields of the next element after P1 and those of the elements indicated by P1. If there are no elements after P1, the duration of the pulse is $T_{ref}/2$. In block 77, the highest possible value of the acceleration reference pulse to be added is determined so that the absolute value of the sum of the old acceleration reference and the one to be added never exceeds the value of $ACC_p$, and the duration of the reference pulse is so adjusted that the desired final speed will not be exceeded (blocks 78, 79). The first pulse $ACC_1$ of the new acceleration reference is started at instant TIME and the second pulse $ACC_2$ at instant $TIME+T_{ref}/2$ (block 80). If the desired speed has not been reached, execution proceeds to the next element (blocks 81 and 82).

Within the framework of the procedure of the invention, overall swing can be eliminated and the velocity of the traversing motion changed in several ways differing from each other in respect of the timing and magnitude of the changes of acceleration. These can be subject e.g. to the following conditions:

- the stopping distance from the position of the load at the instant of entry of the speed reference v=0 to the final position is to be minimized,
- the overswing occurring when the load is stopped or its direction of motion changed is to be minimized,
- a constant stopping distance is to be maintained regardless of the speed and the angle of deflection at the instant when the speed setting v=0 or a speed setting requiring a change of direction is given
- the stopping distance is to be independent of the angle of deflection at the instant when the speed setting v=0 is entered (unambiguous function of initital speed).

It is obvious to a person skilled in the art that the invention is not restricted to the examples described above, but that it may instead be varied within the scope of the following claims.

We claim:

1. In a crane wherein a load is suspended on a hoisting rope from a trolley supported by a bridge, a method of damping load swing during traversing movement of the trolley and/or bridge driven by a traversing motor under control of at least one command signal representative of trolley and/or bridge speed, comprising the steps of:

(a) determining a length of the hoisting rope and calculating a load oscillation period therefrom;

(b) determining if a speed change command signal has been developed;

(c) developing a prevailing swing compensation signal to compensate for swing prevailing at a time when the speed change command is developed;

(d) developing speed change acceleration signals in response to a new speed setting from the speed command signal; and (e) additively applying the acceleration signals and the swing compensation signals to the traversing motor change load speed while minimizing load sway.

2. The method as claimed in claim 1, further comprising the steps of:

(f) determining a prevailing momentary total oscillation generated by previous control actions from an equation considering rope length and acceleration from previous reference signals;

said step (c) developing a first acceleration reference and a second acceleration reference;

(g) compensating a final acceleration caused by application of the first acceleration reference in said step (e); and (h) determining magnitude, direction and starting moment of the first acceleration reference from a angle of deflection of the rope at a moment the acceleration reference is determined.

3. The method as claimed in claim 2 wherein the first acceleration reference has a first magnitude and said step (c) includes the step of:

(c1) developing the second acceleration reference as two equal acceleration reference changes having opposed polarities and a magnitude equal to one half the first magnitude and having a time interval therebetween equalling half a time of oscillation.

4. The method as claimed in claim 2 wherein the acceleration signals include first and second acceleration sequences of equal duration and magnitude, a time interval between a beginning of the two sequences being equal to half of an oscillation cycle.

5. The method as claimed in claim 1, further comprising the step of:

(f) monitoring a total momentary oscillation to determine if the total momentary oscillation exceeds a predetermined limit during a traversing moment before a speed change command is received in said step (b) and, when the total momentary oscillation exceeds the predetermined limit, performing said step (c).

6. The method as claimed in claim 1 wherein said step (d) comprises the steps of:

(d1) forming a first acceleration sequence; and (d2) forming a second acceleration sequence, the second acceleration sequence being separated from the first acceleration sequence by a half cycle of oscillation;

said step (c) monitoring the first and second acceleration sequences and removing the first acceleration sequence after a first point of time when the speed change command is developed and removing the second acceleration sequence a half cycle of oscillation from the first point of time.

7. The method as claimed in claim 6 wherein said step (d) begins forming the acceleration sequences when a new speed change is received and the acceleration sequences are formed until the desired speed has been reached.

8. The method as claimed in claim 7 wherein the method periodically updates all measurements and calculations and periodically monitors for speed change commands.

9. The method as claimed in claim 1 wherein said step (e) adds the swing compensation signals and the speed changing acceleration signals to form an overall control signal which is applied to the traversing motor.

10. The method as claimed in claim 1, further comprising the steps of:

(f) monitoring motor current and speed; and (g) limiting acceleration and speed so as not to exceed the limits of the motor.

11. In a crane wherein a load is suspended on a hoisting rope from a trolley supported by a bridge, a method of damping load swing during traversing movement of the trolley and/or bridge driven by a traversing motor under control of at least one command signal representative of trolley and/or bridge speed, comprising the steps of:

(a) determining a length of the hoisting rope and calculating a load oscillation period therefrom;

(b) determining if a speed change command signal has been developed;

(c) developing a prevailing swing compensation signal to compensate for swing prevailing at a time when the speed change command is developed;

(d) developing speed changing acceleration signals in response to a new speed setting from the speed command signal;

(e) additively applying the acceleration signals and the swing compensation signals to the traversing motor change load speed while minimizing load sway;

(f) determining a prevailing momentary total oscillation generated by previous control actions from an equation considering rope length and acceleration from previous reference signals;

said step (c) developing a first acceleration reference and a second acceleration reference;

(g) compensating a final acceleration caused by a application of the first acceleration reference in said step (e); and (h) determining magnitude, direction and starting moment of the first acceleration reference form an angle of deflection of the rope and oscillation velocity at a moment the acceleration reference is determined.

12. The method as claimed in claim 11 wherein the first acceleration reference has a first magnitude and said step (c) includes the step of:

(c1) developing the second acceleration reference as two equal acceleration reference changes having opposed polarities and a magnitude equal to one half the first magnitude and having a time interval therebetween equalling half a time of oscillation.

13. The method as claimed in claim 11 wherein the acceleration signals include first and second acceleration sequences of equal duration and magnitude, a time interval between a beginning of the two sequences being equal to half of an oscillation cycle.

14. The method as claimed in claim 11 further comprising the steps of:

(i) monitoring a total momentary oscillation to determine if the total momentary oscillation exceeds a predetermined limit during a traversing movement before a speed change command is received in said step (b) and, when the total momentary oscillation exceeds the predetermined limit, performing said step (c).

15. The method as claimed in claim 11 wherein said step (d) comprises the steps of:

(d1) forming a first acceleration sequence; and (d2) forming a second acceleration sequence, the second acceleration sequence being separated from the first acceleration sequence by a half cycle of oscillation;

said step (c) monitoring the first and second acceleration sequences and removing the first acceleration sequence after a first point of time when the speed change command is developed and removing the second acceleration sequence a half cycle of oscillation from the first point of time.

16. The method as claimed in claim 15 wherein said step (d) begins forming the acceleration sequences when a new speed change command is received and the acceleration sequences are formed until the desired speed has been reached.

17. The method as claimed in claim 16 wherein the method periodically updates all measurements and calculations and periodically monitors for speed change commands.

18. The method as claimed in claim 11 wherein said step (e) adds the swing compensation signals and the speed changing acceleration signals to form a overall control signal which is applied to the traversing motor.

19. The method as claimed in claim 11, further comprising the steps of:

(i) monitoring motor current and speed; and (j) limiting acceleration and speed so as not to exceed the limits of the motor.

* * * * *